US005676243A

United States Patent [19]

Sanders

[11] Patent Number: 5,676,243

[45] Date of Patent: Oct. 14, 1997

[54] COMBINATION KEYHOLDER, CONTAINER AND CLIP

[76] Inventor: Calvin E. Sanders, 18608 Walker-Rd., Lutz, Fla. 33549

[21] Appl. No.: 534,399

[22] Filed: Sep. 27, 1995

[51] Int. Cl.[6] ..... A45C 11/00

[52] U.S. Cl. ..... 206/38.1; 206/37.1; 206/38; 224/555; 224/668

[58] Field of Search ..... 206/38, 38.1, 37, 206/37.1, 37.5, 37.3, 37.4, 37.8; 24/3.1, 3.7, 3.11, 3.12; 224/269, 255, 163, 182, 235, 555, 666–670

[56] References Cited

U.S. PATENT DOCUMENTS

| | | | |
|---|---|---|---|
| 1,538,593 | 5/1925 | Rolfs | 206/37.5 |
| 1,685,765 | 9/1928 | Mangan | 206/259 |
| 2,416,477 | 2/1947 | Gamache | 206/37.1 X |
| 2,596,716 | 5/1952 | Otten | 206/37.1 X |
| 3,084,407 | 4/1963 | Settles | 24/3.12 X |
| 3,111,152 | 11/1963 | Goessling | 206/37.8 X |
| 4,658,479 | 4/1987 | Sanders | 24/67.9 |
| 5,103,884 | 4/1992 | Roman | 224/269 X |
| 5,123,525 | 6/1992 | Orlowski | 206/5 |
| 5,305,874 | 4/1994 | McLaughlin | 206/37 |
| 5,370,219 | 12/1994 | Violett, Jr. | 206/38 |

*Primary Examiner*—Jimmy G. Foster
*Attorney, Agent, or Firm*—Foley & Lardner

[57] ABSTRACT

A combination water tight storage container and an attaching clip wherein the container has an opening therein and a cap thereon. A clip formed of a single, continuous length of multiply bent resilient material defining a plurality of loops is frictionally inserted into a slot in the wall of the container. The clip and container forming a gripping tension therebetween when inserted into a hole on the underside of a vehicle or on an article of clothing.

6 Claims, 4 Drawing Sheets

COMBINATION KEYHOLDER, CONTAINER AND CLIP

BACKGROUND OF THE INVENTION

1. Field of the Invention

The invention relates to a container for holding spare keys and other items, the container being constructed to be clipped onto an under-portion of an automobile, on a belt or on other objects.

1. Related Art

The instant invention incorporates a clip device as illustrated in my prior U.S. Pat. No. 4,658,479, which patent is incorporated by reference.

In order to have a spare key available in conjunction with automobiles, a common practice has been to employ a small container which incorporates a magnet or a plurality of magnets attaching the container to the underside of a vehicle.

As illustrated in my prior U.S. Pat. No. 4,658,479, a clip may be used to secure a spare key at an unseen location, for example, on an under-portion of an automotive vehicle. The entire key clip holder is slid over a thin metal portion or in an opening in the frame on the underside of the vehicle. The firm resilient force or tension provided by the composition, and particularly the rectangular or square portion, provides a "staying power" necessary to retain the spare key in place as the vehicle travels.

Present day automobile designs include circular, oval or square-shaped holes cut out in the frame of the vehicle.

OBJECTS AND SUMMARY OF THE INVENTION

The instant invention combines many of the attributes of the clip device in my prior patent, together with the ability to provide a water tight box which may be constructed of rigid, yet floatable, material.

An object of the invention is to provide a container which will float and is large enough to be able to retain such items as small pieces of jewelry, a watch, keys, money, credit cards, boat registrations, matches, etc. In other words, any small item which is desired to be kept dry and/or secure.

The invention is specifically designed to be used to store keys and other items on the frame of a vehicle by securing a container to the frame by attaching it through an opening or hole wherein.

Another object is to be able to secure the combined container and clip to a belt or other piece of wearing apparel or on numerous other objects.

Another object is to be able to attach a key onto the clip which is in turn secured to a container.

The invention includes a combination water tight storage container and an attaching clip wherein the container has an opening therein and a cap thereon. A clip formed of a single, continuous length of multiple-bent resilient material defining a plurality of loops is frictionally inserted into a slot in the wall of the container. The clip and container form a gripping tension therebetween when inserted into a hole on the underside of a vehicle or on an article of clothing.

BRIEF DESCRIPTION OF THE DRAWINGS

The above and other objects and advantages will become apparent from the following description and accompanying drawings, wherein:

FIG. 9 is a view of the clip mounting the container in an opening on the frame of a vehicle or the like;

DETAILED DESCRIPTION OF THE PREFERRED EMBODIMENTS

Figure 1:
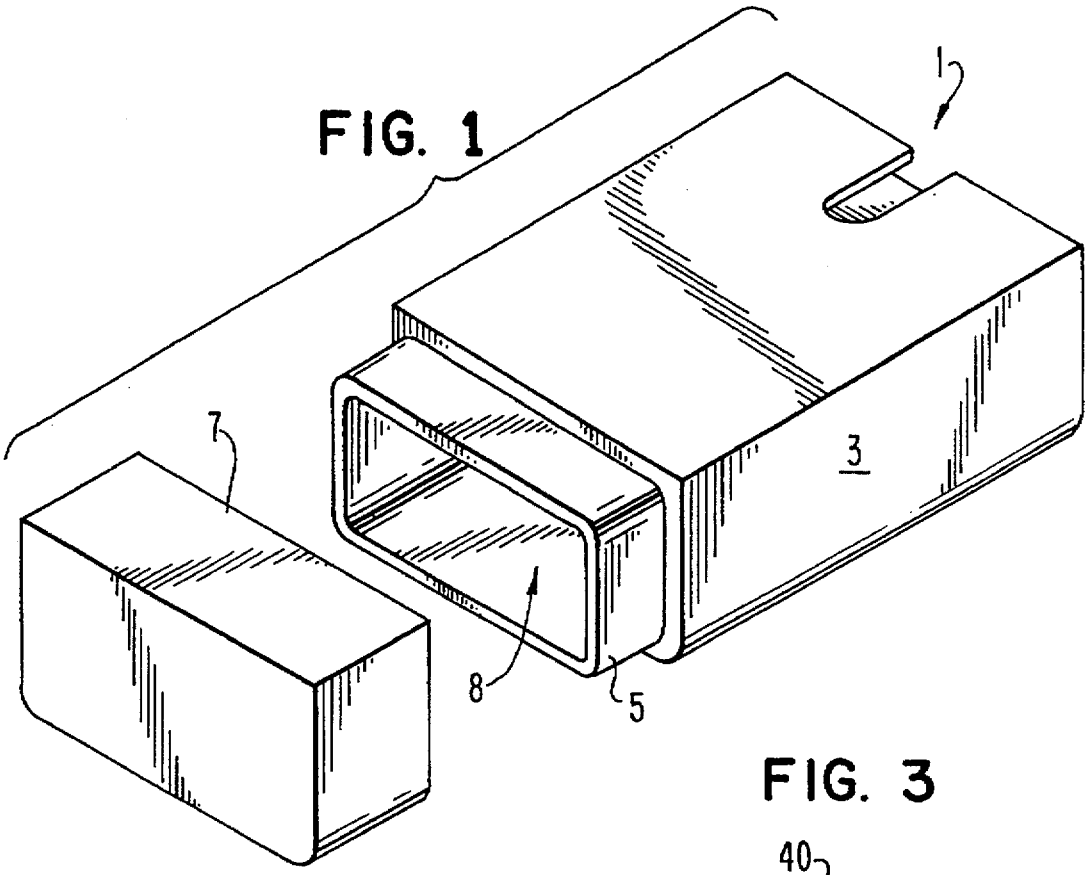
FIG. 1 is a perspective view of the container of the instant invention with the cap separated from the container portion.
Figure 3:
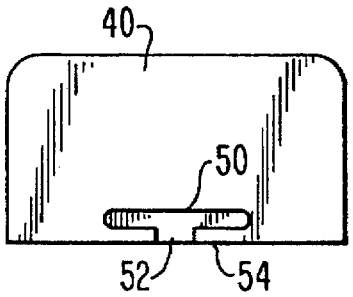
FIG. 3 is a bottom plan view thereof.
Figure 2:
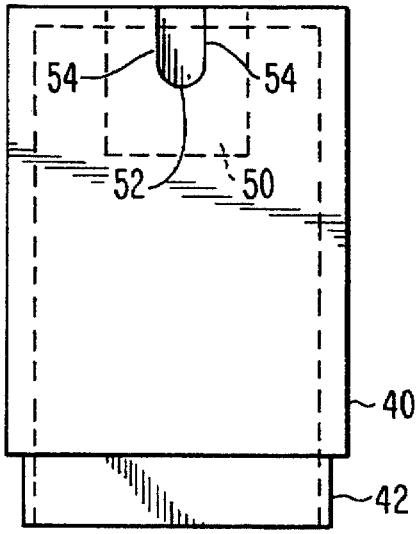
FIG. 2 is a side elevational view thereof.

A container 1 includes a container portion 3 formed by a plurality of side walls and a bottom wall having a recessed end 5 with a frictionally engagable cap 7. The container 3 has an open or hollow portion 8, and the cap has a complementary open portion 9. The container is substantially water tight to preclude entry of moisture under normal use.

Figure 6:
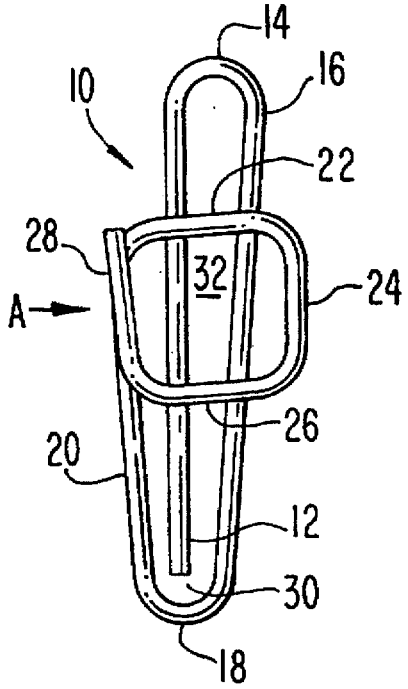
FIG. 6 is a front elevational view of a clip device used with the container.

The clip device as illustrated in U.S. Pat. No. 4,658,479 is again described here with reference to FIGS. 6 and 7 of the drawings. Referring first to FIG. 6, the clip 10 comprises a series of legs and arcuate and square loops formed from a single, continuous length of resilient, heavy gauge wire material. The wire preferably is formed of brass.

Extending from one end of the length of the resilient material is a first leg 12. The first leg 12 continues a first distance in a first direction and extends to a first arcuate portion 14. The arcuate portion 14 continues into a second leg 16 which extends a second distance, preferably a distance greater than the distance of the first leg 12. The second leg 16 extends in a direction substantially opposite that of the first leg 12. The second leg extends to a second arcuate portion 18 which continues to and terminates into a third leg 20.

The third leg 20 extends generally in the direction of the first leg 12. Preferably, the first leg 12 and the third leg 20, while extending in the same general direction, are not exactly parallel to one another for reasons to be discussed below. Furthermore, the length of the third leg 20 is preferably less than the length of the second leg 16.

The third leg 20 terminates into a first substantially square loop 22 which continues to and terminates into a fourth leg 24. The distance across the square loop from the third leg 20 to the fourth leg 24 is at least equal to, but preferably slightly greater than the distance between the first leg 12 and the second leg 16. Accordingly, the square loop portion of the clip occupies a plane above, but immediately adjacent the plane occupied by the first and second legs.

The fourth leg 24 terminates into a second square loop portion 26 which continues to and terminates into a fifth leg 28. Leg 28 extends in the same general direction as the third leg 20 and the first leg 12. Similar to the first square loop portion 22, the second square loop portion 26 extends, from the fourth leg 24 to the fifth leg 28, a distance at least equal to and preferably slightly greater than the distance between the second leg 16 and the third leg 20. Thus, the portion of the clip comprising the fourth leg 24, the second square loop portion 26, and the fifth leg 28 occupy a plane above, but immediately adjacent the plane occupied by the portion of the clip comprising the second leg 16, the second arcuate portion 18, and the third leg 20.

Figure 7:
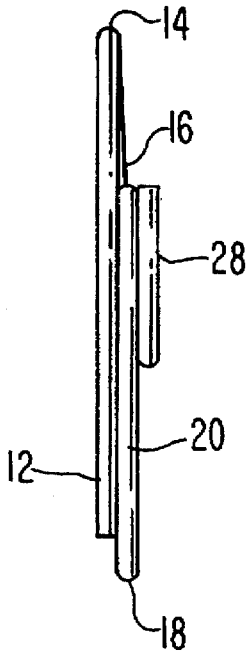
FIG. 7 is a side elevational view in the direction of arrow A of FIG. 6.

Hence, the present clip comprises a resilient material which is multiply bent into a series of substantially arcuate and square loops occupying generally adjacent planes. Reference is made to FIG. 7 which illustrates the present clip in side elevation view taken in the direction of arrow A in FIG. 6. FIG. 7 illustrates the overlay structure of the present clip. Third leg 20 forms a part of an essentially oval structure 30 which further includes first arcuate portion 14, second leg 16 and second arcuate portion 18. This oval structure lies adjacent a portion of the first leg 12 and can be considered to include the lower portion of the first leg. Additionally, a further overlay results from the essentially rectangular structure 32 formed from the first square loop portion 22, the fourth leg 24, the second square loop portion 26, and the fifth leg 28. The phrase "essentially rectangular structure," as presently used, is understood to also include an essentially square structure.

The essentially rectangular structure 32 is generally planar and overlays on the essentially oval structure 30 between the first and second arcuate portions of the oval structure, generally in the vicinity of the middle of the oval and preferably slightly closer to one end of the oval. By positioning the rectangular portion closer to one end of the oval structure, the arcuate portion of the other end of the clip can serve as a handle for the clip.

Figure 4:
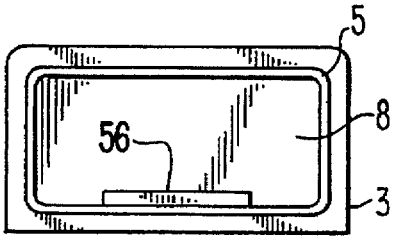
FIG. 4 is a top plan view thereof with the cover removed.
Figure 5:
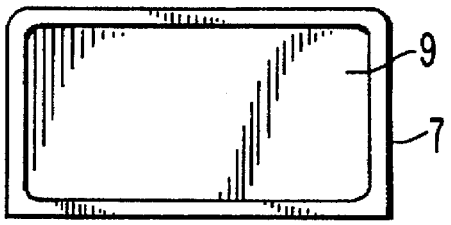
FIG. 5 is a bottom plan view of the cap.

The clip 10 is frictionally engaged to the container 1 by use of a recessed slot 50 extending into the side of the container and having an opening 52 which is partially formed by a pair of side edges 54. Slot 50 is at the end of container 1 opposite the opening 8. Depending upon the thickness of the container or material forming the container there may be a housing for the slot extending into the interior of the container as seen at 56 in FIG. 4.

The container is formed preferably of a styrene derivative of a composition and thickness such that the container will float. The clip may be made of a variety material; however, as stated above, it has been found that a spring tempered brass is the presently preferred material since it will not rust. Also, it has a better "memory" than many other metals.

The width and depth of slot 50 are designed to receive the square portion 32 bounded by sides 22–28. Side 28 flexes such that the sides 24 and 28 provide the staying power to retain the clip within the slot 50. The side edges 54 also bend or flex in conjunction with the clip in order to further assist in the gripping or holding.

Figure 12:
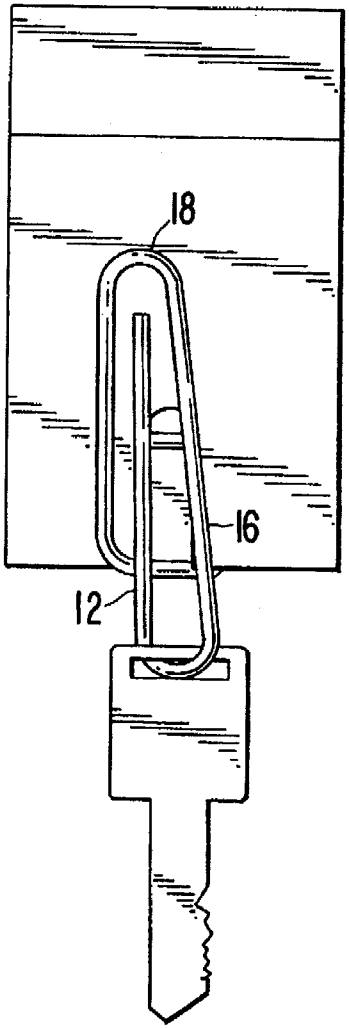
FIG. 12 shows the container and clip with a key on the clip.

When the unit is in use, spare keys and/or other valuables may be inserted into the opening 8, and the cap is placed thereover. Alternatively, when one is, for example, at the beach or on a boat, the key can be placed on the clip as seen in FIG. 12.

Figure 9:
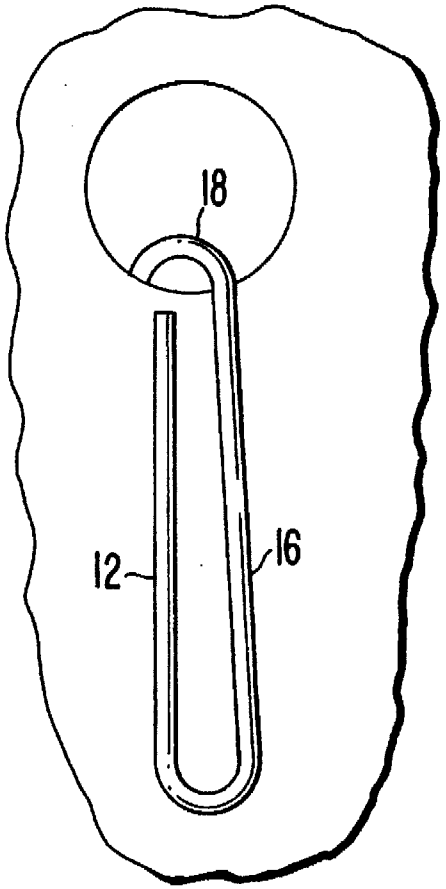

The combined unit may be attached to an object such as the underside of the vehicle through a hole or opening, in the frame by inserting portion 14 into the hole frame. Tension is provided by portions 12-14-22-24-26-28 when the clip is inserted into the hole, and it remains on the inside of the frame with the box and remaining portions on the outside of the frame. (See FIG. 9) Portion 18 provides a transitional barrier between the inside and the outside and remains for the most part in the vehicle frame hole.

Figure 10:
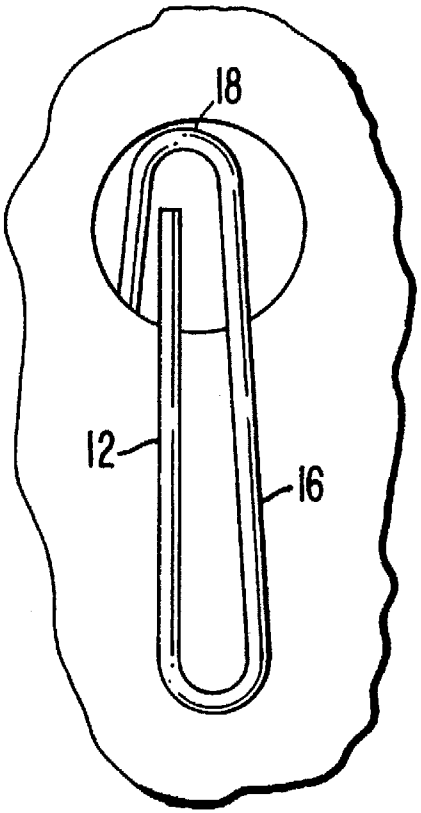
FIGS. 10 & 11 illustrate the clip in various positions where removal is attempted.
Figure 11:
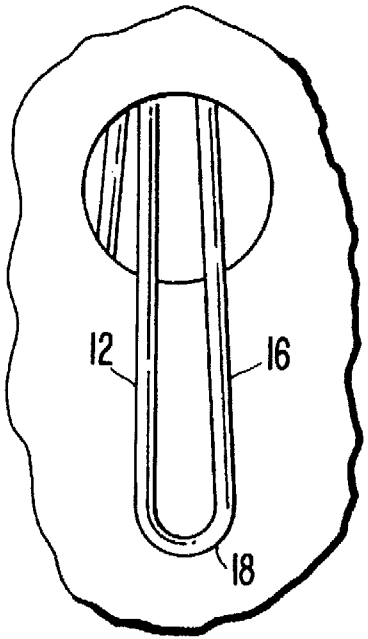

The clip is held on the frame by the gripping tension between portion 12-14-22-24-26-28 and the frame with the container on the other side of the frame. It will be appreciated that portion 18 will abut against the edge of the hole or opening if it is attempted to be removed without the proper care. (See FIG. 10) Alternatively, when someone improperly attempts to remove the container, portion 18 will slide over the end of the opening and remain on the inside. (See FIG. 11) Alternatively, the tip of portion 12 will abut against the opening if portion 18 is able to slide outside the frame hole. (Also, see FIG. 11)

Rather than using cap 7, the container may be made in different configurations. For, example, one side of the container can be formed to slide to open the entire length of the container as is common in the art.

Figure 8:
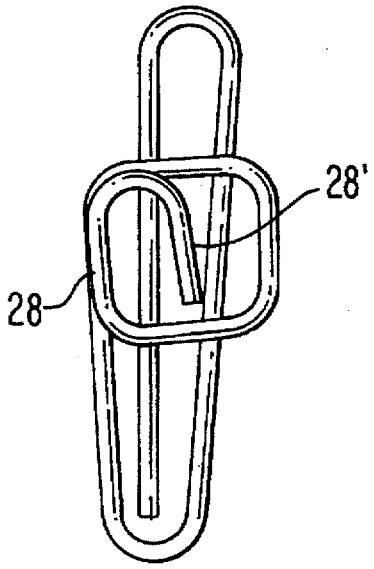
FIG. 8 is a front elevational view of a slightly modified clip.

With reference to FIG. 8, a portion 28' extends around and down from portion 28 and precludes the end 28 from being flexed too far inwardly. Also, a tool may be inserted through slot 52 and into the opening between portions 28 and 28' in order to further adjust the tension.

The unit can obviously be clipped on a belt, shorts, a towel, a beach bag, tackle box or the like. Since the container is water tight, it can also be placed in ice chests, tackle boxes, etc. with the key in the position seen in FIG. 12. Items such as jewelry, money, boat registrations, etc. can be placed inside while still using the key.

While the slot 50 is preferably formed within or substantially within the container wall, it would be obvious to have an extension on the inside of the wall with a slot-type configuration therein. The claimed invention is intended to cover various similar forms of constructions.

While several embodiments of the invention have been described, it will be understood that it is capable of further modifications, and this application is intended to cover any variations, uses, or adaptations of the invention, following in general the principles of the invention and including such departures from the present disclosure as to come within knowledge or customary practice in the art to which the invention pertains, and as may be applied to the essential features hereinbefore set forth and falling within the scope of the invention or the limits of the appended claims.

What is claimed is:

1. A combination storage container and attaching clip comprising:

(a) a container portion formed by a plurality of walls and having an opening therein;

(b) a cover over the opening to substantially close the container;

(c) a recessed slot associated with one of the walls;

(d) a clip formed from a single continuous length of multiply bent resilient material defining a plurality of loops, one portion of which being frictionally received in the slot, and another portion of which forming a gripping tension between the container and the clip when an object is placed between the clip and the container.

2. The combination of claim 1 wherein the slot includes an opening partially formed by a pair of side edges.

3. The combination of claim 1 wherein the cover is in the form of a cap frictionally engaging a recessed end of the container.

4. The combination of claim 1 wherein the clip further comprises:

(a) a first leg extending a first distance in a first direction from one end of the resilient material;

(b) a first arcuate portion extending from said first leg;

(c) a second leg extending from said first arcuate portion a second distance in a second direction substantially opposite said first direction;

(d) a second generally arcuate portion extending from said second leg, whereby a generally oval portion is formed by said first and second legs and first and second arcuate portions;

(e) a third leg extending from said second arcuate portion a third distance in a third direction;

(f) a first rectangular loop portion extending at a generally right angle from said third leg substantially crossing and exerting a pressure on said first and second legs;

(g) a fourth leg extending from said first rectangular loop portion a fourth distance in a fourth direction at a generally right angle to said first rectangular loop portion; and (h) a second rectangular loop portion extending from said fourth leg substantially crossing and exerting a pressure on at least one of said first and second legs;

(i) wherein an essentially rectangular portion is formed by said third and fourth legs and first and second rectangular loop portions, the essentially rectangular portion being a continuation of said oval portion and being positioned on and exerting a pressure on said oval portion.

5. The combination of claim 4 wherein said substantially rectangular portion is substantially square.

6. The combination of claim 1 wherein the container is made of a material which floats in normal use.

* * * * *